US009859644B2

(12) United States Patent
Hu

(10) Patent No.: US 9,859,644 B2
(45) Date of Patent: Jan. 2, 2018

(54) CONTACT ELEMENT

(71) Applicant: Robert Bosch GmbH, Stuttgart (DE)

(72) Inventor: Zhenyu Hu, Leonberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/504,169

(22) PCT Filed: Jul. 31, 2015

(86) PCT No.: PCT/EP2015/067625
§ 371 (c)(1),
(2) Date: Feb. 15, 2017

(87) PCT Pub. No.: WO2016/030129
PCT Pub. Date: Mar. 3, 2016

(65) Prior Publication Data

US 2017/0271803 A1 Sep. 21, 2017

(30) Foreign Application Priority Data

Aug. 25, 2014 (DE) ..... 10 2014 216 864

(51) Int. Cl.
*H01R 13/432* (2006.01)
*H01R 13/187* (2006.01)
(Continued)

(52) U.S. Cl.
CPC ..... *H01R 13/432* (2013.01)

(58) Field of Classification Search
CPC .. H01R 13/432; H01R 13/187; H01R 13/428; H01R 13/113; H01R 13/26; H01R 13/18;
(Continued)

(56) References Cited

U.S. PATENT DOCUMENTS 4,726,792 A 2/1988 Shindo
4,932,877 A * 6/1990 Zinn ..... H01R 13/18 439/839
(Continued)

FOREIGN PATENT DOCUMENTS

DE 19812935 A1 10/1998
DE 202010009329 U1 10/2010
(Continued)

OTHER PUBLICATIONS

International Search Report of PCT/EP2015/067625 dated Oct. 6, 2015.

*Primary Examiner* — Amy Cohen Johnson
*Assistant Examiner* — Matthew T Dzierzynski
(74) *Attorney, Agent, or Firm* — Norton Rose Fulbright US LLP; Gerard Messina

(57) ABSTRACT

A contact element for insertion in an insertion direction into a contact chamber of a plug-in connector. The contact element includes a housing extending in the insertion direction. The contact element furthermore includes a latching element connected to the housing, for latching into the contact chamber of the plug-in connector. The latching element has a cantilevered end region, the cantilevered end region having a first portion and a second portion connected to the first portion. The first portion extends oppositely to the insertion direction, or the first portion points obliquely outward from the housing oppositely to the insertion direction. The second portion is bent over inward with respect to the first portion. At least one support element is provided between the first portion and the second portion, which element braces the second portion against the second portion upon said application of force onto the latching element.

9 Claims, 10 Drawing Sheets

(51) Int. Cl.
*H01R 13/428* (2006.01)
*H01R 13/26* (2006.01)

(58) Field of Classification Search
CPC ..... H01R 13/4223; H01R 13/434; H01R 13/4364; H01R 13/6272; H01R 13/7033
USPC ..... 439/746, 748, 744
See application file for complete search history.

(56) References Cited

U.S. PATENT DOCUMENTS 5,240,439 A * 8/1993 Egenolf ..... H01R 13/18 439/745
5,362,260 A * 11/1994 Peloza ..... H01R 13/428 439/746
5,489,223 A * 2/1996 Faje ..... H01R 13/432 439/748
5,624,283 A * 4/1997 Hotea ..... H01R 13/18 439/745
5,664,972 A * 9/1997 Zinn ..... H01R 13/113 439/839
5,997,363 A * 12/1999 Joly ..... H01R 13/521 439/748
6,066,007 A * 5/2000 Huang ..... H01R 13/432 439/748
6,126,495 A * 10/2000 Lolic ..... H01R 13/18 439/752.5
6,361,377 B1 * 3/2002 Saka ..... H01R 13/7032 439/745
6,679,736 B2 * 1/2004 Saka ..... H01R 13/432 439/748
6,994,596 B2 * 2/2006 Katsuma ..... H01R 13/432 439/746
7,731,550 B2 * 6/2010 Falchetti ..... H01R 13/113 439/843

FOREIGN PATENT DOCUMENTS

DE 102009054705 A1 6/2011
DE 102011080362 A1 2/2013
DE 102012206258 A1 10/2013
EP 1289071 A2 3/2003
TW 201340479 A 10/2013

* cited by examiner

CONTACT ELEMENT

FIELD

The present invention relates to a contact element.

BACKGROUND INFORMATION

In the field of engineering, for example in automotive engineering, it is often necessary to connect electrical conductors to one another. For example, cables need to be connected to one another or attached to electrical devices. Plug-in connectors, in which one or more contact chambers are provided in a plug-in connector housing, are often used for this. A contact element connected to an electrical conductor is disposed in each of the contact chambers and immobilized therein. The contact element is embodied to create an electrically conductive connection to a correspondingly configured mating contact element of a mating plug-in connector, or a socket, as soon as the plug-in connector is plug-fitted together with the mating plug-in connector or socket.

In the context of the manufacture of such plug-in connectors, the contact elements onto whose rear end the pertinent cables are crimped are slid into the individual contact chambers. In order to prevent the contact elements from sliding out of the contact chambers, for example in the event of a pull on the cable, the contact elements are usually immobilized in positively engaged fashion in the contact chambers. In one configuration of the contact elements which is often used, an inwardly deflectable latching element that projects outward, or a latching tip, is provided for this purpose on the housing of the contact element. This latching element projects obliquely outward, oppositely to an insertion direction of the contact element into the contact chamber, beyond the housing of the contact element. Upon sliding of the contact element into the contact chamber, the latching element firstly is elastically deformed inward and then, upon reaching its destination position, is able to snap into a recess (a latching chamber) in the contact chamber in order thereby to immobilize the contact element in the contact chamber.

German Patent Application No. DE 10 2009 054 705 A1 describes a conventional electrical contact element, equipped with a projecting latching element, for plug-in connections.

SUMMARY

In accordance with the present invention, in particular for use in motor vehicles, considerable mechanical demands are made on plug-in connectors and the contact elements used therein. On the one hand, the immobilization of the contact elements within the contact chambers of the plug-in connector must be as stable as possible in order to prevent the contact elements from being torn out, for example if cables crimped thereonto are pulled. Generally, the latching element should be as flexurally stiff as possible for this purpose. On the other hand, for population of the contact elements into the contact chambers, the latching element should be capable of elastically yielding, and then returning to its original position in the latching chamber, as easily as possible, so that a contact element can be immobilized in simple and reliable fashion in a contact chamber.

In addition, sealing mats made of an elastic material, through which the contact elements are pushed upon insertion into the contact chambers, are often disposed in the plug-in connector housings in order to protect the contact elements and contact chambers. If it becomes necessary to remove one or more contact elements from the respective contact chamber, for example for maintenance purposes or because the contact element was inserted into an incorrect contact chamber upon population of the plug-in connector, the risk exists that the latching element projecting obliquely outward oppositely to the insertion direction, or the latching tip, may damage the sealing mat and thereby limit the sealing function. For this purpose, it is possible to provide in a cantilevered end region of the latching element a first portion that projects outward from the housing oppositely to the insertion direction, and a second portion that is bent over inward with respect to the first portion, thus avoiding a sharp-edged outwardly projecting end of the latching element.

With such contact elements, upon an application of force onto the latching element, for example due to a pull on the cable crimped onto the contact element, the second portion can relatively easily slide outward, transversely to the insertion direction, against the wall of the latching chamber. The result is that the latching element can be exposed to relatively large mechanical loads at its root, i.e., at its connecting point with the housing, and in the worst case a breakage of the latching element can occur. Especially with very tall or open latching chambers, the outwardly directed sliding of the second portion of the latching element cannot be stopped, for example, by a cover of the latching chamber before damage to the latching element is possible.

With such contact elements, in particular with miniaturized contact elements in which considerable mechanical demands are made despite a small overall size and thin material thicknesses, the sliding process of the second portion can furthermore be facilitated by the fact that the second portion bends (if applicable, even plastically) increasingly far toward the first portion, with the result that the sliding surface of the second portion is always oriented approximately parallel to the latching chamber wall.

There can thus be a need to furnish a contact element in which, thanks to a novel design of the latching element, the stability of the latching element or latching tip upon an application of force onto the latching element or latching tip is enhanced, and which impedes outward sliding of the second portion or of the latching tip within the latching chamber, in particular in tall latching chambers or ones open toward the top.

SUMMARY

Advantageous embodiments of the present invention are described herein.

Features, details, and possible advantages of a contact element in accordance with embodiments of the present invention are discussed in detail below.

According to a first aspect of the present invention, a contact element for insertion in an insertion direction into a contact chamber of a plug-in connector is proposed, which element exhibits a decreased risk of sliding of the latching element in the latching chamber upon an application of force onto the latching element, while at the same time the risk of damage to a mat seal or sealing mat upon removal of the contact element from the contact chamber is greatly reduced. At the same time, in the general context of an application of force onto the contact element, bending of the latching element or bending of constituents of the latching element, especially (in particular, plastic) bending of the latching element or of parts of the latching element, is to be avoided thanks to the invention, or, as a result of the present invention, a (plastic) bending process of this kind or breakage of components is to occur only upon an application of force that is elevated with respect to the existing art.

This is achieved by the fact that the contact element has a housing extending in the insertion direction. The contact element furthermore has a latching element connected, preferably fixedly connected, to the housing, for latching into the contact chamber of the plug-in connector. The latching element has a cantilevered end region. The cantilevered end region has a first portion, and a second portion connected to the first portion. In particular, the second portion directly adjoins the first portion. The first portion extends oppositely to the insertion direction, or the first portion points obliquely outward from the housing oppositely to the insertion direction. The second portion is bent over inward (e.g., facing toward the housing of the contact element) with respect to the first portion. According to the present invention, provision is made in this context that at least one support element is provided between the first portion and the second portion, which element braces the second portion against the second portion upon an application of force onto the latching element.

The contact element according to the present invention has the advantage, as compared with the existing art, that upon an application of force onto the latching element, for example as a result of a pull oppositely to the insertion direction on the cable connected to the contact element, the second portion can be bent to a greater extent with respect to the first portion only with an exertion of force which is elevated with respect to conventional latching elements. This is because the second portion can brace against the first portion as a result of the support element between the first portion and the second portion. The risk of deformation, in particular excessive deformation, of the latching element is thereby advantageously also decreased. The risk of breakage of the latching element can thereby in turn be decreased. The support element acts in two ways:

On the one hand, the support element prevents the latching element, pivoting outward in the latching chamber, from sliding particularly easily along the chamber wall of the latching chamber upon an application of force onto the latching element.

This is because without the support element, especially in the context of miniaturized contact elements having very thin sheet thicknesses, the second portion can bend in such a way that it is always oriented approximately parallel to the chamber wall of the latching chamber. A sliding process is thereby facilitated by a large contact area with the chamber wall. The pressure (pressure=force per unit area) necessary for retention in the wall is reduced as compared with, for example, a sharp end of a latching element or a latching element having no second portion, since the force is distributed over the area of the second portion.

In the case of a contact element having a support element, according to the present invention the second portion can brace against the first portion by way of the support element. As a result, upon a pivoting of the latching element the second portion can no longer be bent substantially parallel to the chamber wall of the latching chamber. As pivoting of the latching tip increases, a constantly decreasing area of the second portion is thus in contact with the chamber wall. As compared with the scenario described above (with no support element and with a second portion that bends as a result), with a contact element according to the present invention the pressure of the second portion on the chamber wall thus advantageously increases. The second portion can thereby actually dig into the chamber wall similarly to a crampon, with the result that further pivoting of the latching element is impeded or in fact prevented. It is thereby possible to prevent the exceedance of a critical pivot angle at which the latching element, for example, can break at its root.

As a second effect, the torque acting on the latching element can be reduced as a result of the bracing, by the fact that the lever arm acting on the latching element is shortened. Because the latching element projects obliquely outward, a torque (T) acts on the latching element in the event of a pull, for example oppositely to the insertion direction. This torque (T) is determined by the pulling force and the lever arm acting perpendicularly to the force, in accordance with the equation torque (T)=force (F)×lever arm (R), i.e. $T=F\times R$. The lever arm is determined here by the distance between the root of the latching element and the point at which the latching element engages against the chamber wall of the latching chamber transversely to the insertion direction. With a bendable second portion, the force input into the latching element occurs substantially at the end of the first portion, i.e. at the transition region to the second portion. If, on the other hand, the second portion can brace against the first portion by way of the at least one support element, force introduction into the latching element then occurs substantially at the point where the second portion contacts the chamber wall, and via the support element. As compared with the scenario with a bendable second portion, the lever arm is shortened by a distance difference $\Delta R$ in the springback direction. The distance difference is determined by the distance from the transition point between the first and second portion on the one hand, to the point at which the second portion contacts the chamber wall of the latching chamber or the engagement point of the support element against the first portion. The torque acting on the latching element is thus reduced by the contact element according to the present invention. The risk of damage to the latching element or of breakage of the contact element, for example at the root of the latching element, is thereby appreciably reduced as compared with conventional latching elements.

The force that results in damage to the latching element can thereby be, for example, at least 30% greater than without a support element, preferably at least 60% greater.

At the same time, protection of the mat seal or sealing mat from damage as the contact element is taken out of the contact chamber is advantageously maintained.

The latching element can extend substantially oppositely to the insertion direction and can protrude obliquely outward beyond the housing. It can preferably be inwardly deflectable in elastically reversible fashion in the springback direction extending transversely to the insertion direction. The latching element can be disposed or fastened on the housing at a latching element root that is located at an end of the latching element which is remote from the cantilevered end.

The cantilevered end region can be embodied in a manner spaced away from the housing, in particular in the springback direction transversely to the insertion direction. Preferably the cantilevered end region is spaced away from the housing, for example, in an inactive position with no force application.

The latching element can be configured in one piece with the housing or with the contact element. The latching element and/or the housing and/or the contact element can be manufactured as a bent stamped part made of a thin metal sheet.

The second portion can be manufactured from the first portion by a bending process.

The second portion advantageously has a length of at least 0.4 mm, preferably a length of at least 0.7 mm or at least 1.0 mm, and very particularly preferably a length of at least 2 mm. The second portion has at most a length of 5 mm, preferably at most 3 mm, and very particularly at most 2.5 mm. In particular, the length of the second portion can be equal to at least 2.5 times a sheet thickness of a metal sheet from which the second portion can be produced, preferably at least 4 times the sheet thickness. The sheet thickness can be equal, for example in the case of microcontacts, to between 0.05 and 0.4 mm, preferably 0.1 mm to 0.3 mm, and very particularly preferably from 0.12 mm to 0.17 mm. For contacts that are not configured as microcontacts, sheet thicknesses greater than 0.4 mm can also be provided. An end face of the first portion that is, for example, slightly bent as a result of a stamping process is not to be regarded as a "second portion" in the context of the present description.

The bending radius at the transition from the first portion to the second portion can preferably be equal to at most 0.3 mm, very particularly preferably at most 0.1 mm.

The expression "transversely to the insertion direction" can be understood for purposes of the present description as a direction oriented substantially orthogonally to the insertion direction. The expression "transversely to the springback direction" can correspondingly be understood as a direction oriented substantially orthogonally to the springback direction. An axis in the insertion direction, an axis in the springback direction, and a lateral axis that extends transversely to the insertion direction and transversely to the springback direction can thus constitute a Cartesian coordinate system made up of three axes each extending orthogonally to one another.

The expression "outward(ly)" can be understood as a direction proceeding from the housing, which points away from the housing transversely to the insertion direction, for example along an axis parallel to the springback direction. The expression "inward(ly)" can correspondingly refer to a direction toward the housing transversely to the insertion direction.

The expression "of an obliquely outwardly projecting latching element" (in particular in the state not impinged upon by a force) can be understood as a projection of the latching element at an acute angle with regard to the extension direction of the housing. In particular, the latching element and the insertion direction can enclose an angle greater than 1° and less than 89°, preferably an angle between 5° and 55°, very particularly preferably an angle between 5° and 40°. In the context of this application, a right angle and an extension direction parallel to the insertion direction are not encompassed by the expression "oblique."

An advantageous result of the fact that the first portion and the second portion enclose an angle $\alpha$, the at least one support element being configured in such a way that the angle $\alpha$ can be decreased by at most 5° upon an application of force, in particular an application of force oppositely to the insertion direction, onto the latching element, is that the second portion experiences particularly little bending when the latching element pivots outward against the chamber wall as a consequence of an application of force. The result is that on the one hand the above-described effects of the support element (increase in linear pressure and shortening of the lever arm) are achievable particularly quickly or with a small pivot angle of the latching element. At the same time, a certain flexibility of the second portion with respect to the first portion can be maintained. Particularly advantageously, plastic deformation of the second portion with respect to the first portion can be avoided; it is then, for example, only bent elastically reversibly against the support element, and then braced. The second portion can thus, upon release of the application of force and flyback of the latching element inward, for example, fly back inward in elastically reversible fashion into its initial position with regard to the first portion.

According to an embodiment of the present invention, the angle $\alpha$ enclosed by the first portion and the second portion is in a range between 45° and 75°. This advantageously results in particularly simple and inexpensive manufacture of the latching element. In addition, the above-described effects (crampon effect and shortening of the lever arm) occur particularly quickly with such an angle between the first portion and second portion. At the same time, in this angle range the sealing mat disposed in the plug-in connector is particularly effectively protected from damage.

The fact that the at least one support element is configured in one piece with the latching element advantageously results in particularly simple and inexpensive manufacture of the contact element. With miniaturized contact elements in particular, the support element, with its small dimensions, can thereby be manufactured particularly reliably and simply in dependably producible fashion.

According to an embodiment of the present invention, the at least one support element is connected, in particular fixedly connected, to the first portion, and projects from the first portion, oppositely to the insertion direction or substantially oppositely to the insertion direction, toward the second portion. Alternatively or simultaneously, the at least one support element can be connected, in particular fixedly connected, to the second portion and can project from the second portion, in the insertion direction or substantially in the insertion direction, toward the first portion. The fact that the at least one support element extends respectively in the insertion direction or oppositely to the insertion direction brings about particularly efficient bracing. The reason is that as a result, force input from the second portion onto the first portion occurs, at least at the beginning of the application of force, substantially parallel to an application of force onto the latching element brought about, for example, by a pull on the cable of the contact element. At the same time, the lever arm is particularly advantageously reduced. The extension direction of the support element can be determined, for example, in an undamaged inactive state, for example immediately after the process of manufacturing the contact element, or in the inserted state with no application of force.

According to an embodiment of the present invention, the latching element is configured in substantially planar fashion. The latching element has in this context at least one side wall bent inward toward the housing, the at least one side wall having at least one cutout in the first portion. The at least one support element is disposed on the at least one side wall. The at least one support element is disposed in particular in the region of the at least one cutout.

The expression "planar" can be understood as a conformation of the latching element that extends, with the exception of the at least one side wall and the second portion, substantially along a flat area. Thanks to the at least one side wall that imparts to the latching element, in the context of a section transversely to the longitudinal axis, a profile that can correspond to the rotated and/or reflected letter "L" or to an upside-down letter "U", the latching element can advantageously exhibit elevated stability with respect to plastic deformation. The at least one side wall can face with its end face toward the housing of the contact element.

Because the at least one side wall has at least one cutout in the first portion, for example immediately before the transition to the second portion, the latching element can be manufactured in particularly simple and reliably produced fashion with no occurrence in the manufacturing process of an undesired bending of the second portion, of the first portion, or of the side wall as a consequence of overlaps of the side wall, first portion and/or second portion due to production tolerances. An advantageous result of the fact that the at least one support element is disposed on the at least one side wall is that a force input from the second portion into the first portion leads to a particularly greatly reduced lever arm. At the same time, particularly good force distribution in the latching element can be brought about by the introduction of force into the side wall, due to the high area moment of inertia of the at least one side wall.

According to an embodiment of the present invention, the second portion has a free end facing away from the first portion, the at least one support element being disposed on the at least one side wall in such a way that upon an impingement of force onto the latching element, in particular upon an impingement of force in the insertion direction, the second portion braces with its free end against the at least one support element. The advantageous result thereof is that the lever arm is particularly significantly reduced in the context of an upward pivoting movement of the latching tip, in particular when the free end of the second portion, for example, projects particularly far inward toward the housing. Advantageously, particularly simple manufacture of the contact element also thereby becomes possible.

According to an embodiment of the present invention, provision is made that the at least one support element is configured as at least one tab projecting laterally, transversely to the insertion direction, from the second portion. The at least one tab is bent over at least locally in the insertion direction, in particular bent over 90° to 135°. The advantageous result thereof is particularly simple manufacture of the contact element, of the latching element, and of the support element. This is because as a result of the bending of the tab, the tab can come into abutment under the first portion and be very largely covered by the first portion. Production tolerances in the process of bending the tab can thus very largely have no major effects on the supporting effect of the support element, since the coverage of the tab with the first portion, and thus the supporting effect, almost always exist. At the same time, particularly effective bracing can thereby be effected in simple fashion. For example, the bent-over tab can also bring about resilient bracing that allows the second portion to move back elastically into its initial position after the application of force ends. Advantageously, the tab can rest in planar fashion against the first portion as a result of the bending-over process, and thus particularly effectively produce a planar supporting effect.

The advantageous result of the fact that the at least one tab has a free tab end, the free tab end bracing against an inner side, facing toward the housing, of the first portion upon an impingement of force, in particular in the insertion direction, onto the latching element, is that force transfer from the second portion to the first portion can occur over a larger area. On the one hand, the area load on individual points is thereby particularly low. On the other hand, production tolerances in the process of bending the support element, i.e., the tab, have no, or only an insignificant, negative effect on the supporting effect, since the inner side of the first portion represents a particularly large area.

According to an embodiment of the present invention, provision is made that the latching element has a further portion having a first width w1 in a lateral direction transverse to the insertion direction. The first portion is disposed between the further portion and the second portion. The first portion tapers toward the second portion from the first width w1 to a second width w2 of the second portion. The second portion and the tab have, in the lateral direction, a total width w3 that is less than or equal to the first width w1. The advantageous result thereof is that the tab and the second portion do not project laterally beyond the latching element when viewed in the insertion direction. Damage to, for example, the sealing mat upon insertion or removal of the contact element can thereby advantageously be avoided. At the same time, the advantageous result is that the tab acting as a support element can particularly effectively direct the force input into the first portion, for example centeredly into the first portion. Partial bending of the second portion, e.g. to one side, is thereby prevented.

The first width w1 can be equal, for example, to at least 0.3 mm, preferably at least 0.4 mm, and very particularly preferably at least 0.8 mm. The second width w2 can be equal, for example, to at most 75% of the first width w1, preferably at most 50% of the first width, and very particularly preferably at most 30% of the first width w1.

BRIEF DESCRIPTION OF THE DRAWINGS

Further features and advantages of the present invention will be apparent to one skilled in the art from the description below of exemplifying embodiments, which nevertheless are not to be construed as limiting the present invention.

DETAILED DESCRIPTION OF EXAMPLE EMBODIMENTS

All the Figures are merely schematic depictions of apparatuses according to the present invention or constituents thereof, in accordance with exemplifying embodiments of the present invention. In particular, distances and size relationships are not reproduced at exact scale in the Figures. Corresponding elements are labeled with the same reference numbers in the various Figures.

Figure 1:
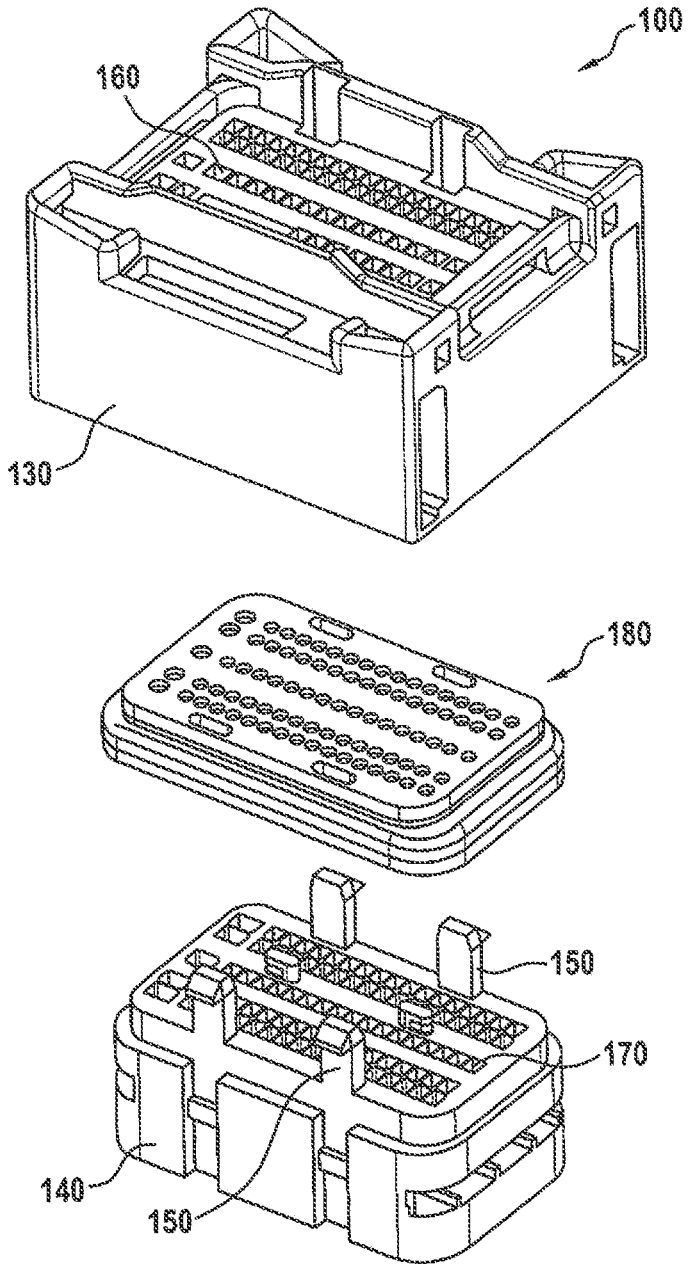
FIG. 1 is an exploded view of a plug-in connector.

FIG. 1 shows a plug-in connector 100 that can be part of a plug-in connection to a mating plug-in connector. Plug-in connector 100 can be used, for example, for mechanical and electrical connection of several cables to one another or of a wiring harness to a control device in a motor vehicle.

Plug-in connector 100 has an upper housing part 130 and a lower housing part 140, which can be mechanically connected to one another via latching tabs 150. A mat seal 180 made of an elastic material, having passthrough openings, is disposed between upper housing part 130 and lower housing part 140. Provided both in upper housing part 130 and in lower housing part 140 are contact chambers 160, 170 through which cables and contact elements fastened thereto (not depicted in FIG. 1) can be introduced into plug-in connector 100 and latchingly fastened therein.

Figure 2A:
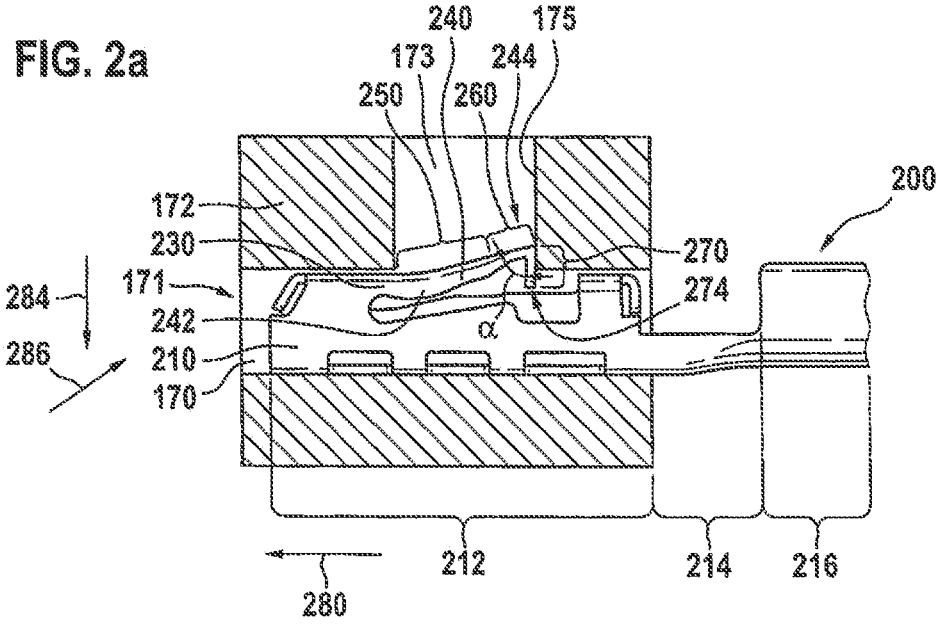
FIG. 2*a* is a perspective view of a contact element according to the existing art in a contact chamber, with no application of force onto the latching element.

FIG. 2*a* shows a contact element 200 in accordance with the existing art.

Contact element 200 has a housing 210 extending in an insertion direction 280. Contact element 200 can be manufactured as a single stamped and bent part from a thin, for example metal, sheet, and preferably is electrically conductive. Contact element 200 furthermore has a latching element 240, connected to housing 210, which extends substantially oppositely to insertion direction 280 and projects obliquely outward from housing 210. Latching element 240 is secured on housing 210 at a latching element root 230. Latching element root 230 can be a singular point at which the transition from housing 210 to latching element 240 occurs. It can also, however, be merely a virtual point around which, for example, a rotation or pivoting of latching element 240 can occur. Latching element 240 is inwardly deflectable elastically reversibly in a springback direction 284 extending transversely to insertion direction 280. A lateral direction 286 extends transversely to insertion direction 280 and transversely to springback direction 284. Contact element 200 is subdivided into a front contact portion 212 in which latching element 240 is disposed. Adjoining contact portion 212 is a center portion 214 that is in turn adjoined by a crimp portion 216 in the rear part of contact element 200. An electrical cable (not depicted here) can be connected in electrically conductive fashion to contact element 200 in crimp portion 216.

Latching element 240 has a cantilevered end region 244. Cantilevered end region 244 is spaced away from housing 240 and has a first portion 260 as well as a second portion 270 connected to first portion 260. In the exemplifying embodiment depicted (i.e., with no external application of force), first portion 260 extends obliquely outward from the housing. Second portion 270 has a free end 274 and is bent over inward with respect to first portion 260, i.e. the second portion faces with its end face, or its free end 274, substantially toward housing 210. First portion 260 and second portion 270 are both configured as substantially planar surfaces and enclose between them an angle $\alpha$. The second portion can have, for example, a length in a range between 0.5 and 2.5 mm.

Latching element 240 furthermore has a further portion 250, further portion 250 being disposed between latching element root 230 and first portion 260. Latching element 240 is configured, along its extension direction 280, substantially as a planar surface, latching element 240 having on its outer sides (with respect to lateral direction 286) side walls 242 each bent over inward.

Contact element 200 is pushed into contact chamber 170 in lower housing part 140 of plug-in connector 100. Contact chamber 170 is delimited by a contact chamber wall 172. Provided at the front end of contact chamber 170 is a contacting opening 171 through which a mating contact element, for example in the form of a plug-in connector pin or contact blade, can be introduced into contact portion 212 of contact element 200. At least one, for example resilient, contact plate (not depicted here), with which the mating contact element is electrically and mechanically contacted, can be disposed in contact portion 212 in the interior of housing 210. An open latching chamber 173 is provided in contact chamber wall 172 in the upper part (in the Figure) of contact chamber 170. Upon insertion of contact element 200, latching element 240 that has deflected inward during the insertion operation can deflect outward into latching chamber 173. When a pull occurs on contact element 200 oppositely to insertion direction 280, the latching element can thus brace against a latching stop 175, configured as a kind of undercut, of latching chamber 173 and thus prevent unintentional release of contact element 200 from contact chamber 170. An unlocking tool can also be introduced, for example, through contacting opening 171 in order to release latching element 240.

Figure 2B:
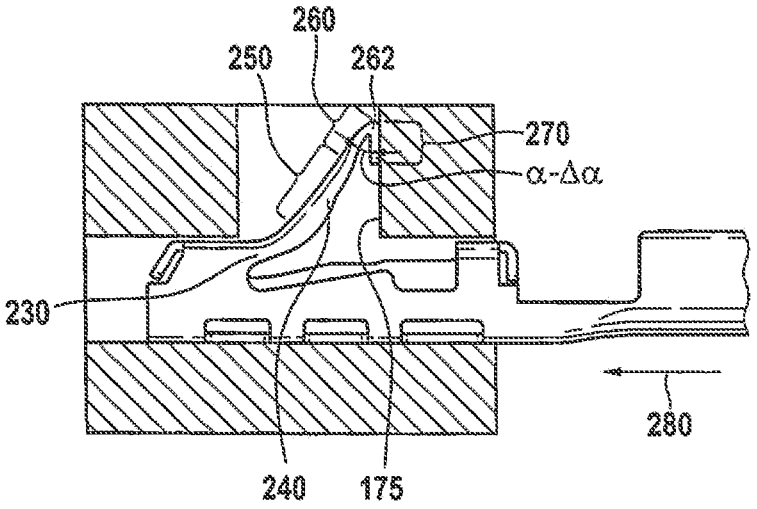
FIG. 2*b* shows the contact element of FIG. 2*a* with an application of force onto the contact element.

FIG. 2*b* shows a situation in which the contact element shown in FIG. 2*a* is impinged upon by a force, for example due to a pull on the cable oppositely to insertion direction 280. If this force exceeds a certain minimum value, latching element 240 can then pivot outward around locking element root 230, and free end region 244 of latching element 240 slides increasingly upward along latching stop 175 in latching chamber 173. In particular with miniaturized contact element having thin sheet thicknesses, second portion 270 can be bent over with respect to first portion 260 increasingly far toward first portion 260. In other words, the angle between first portion 260 and second portion 270 becomes increasingly reduced (by an amount equal to $\Delta\alpha$). This is depicted in the Figure by the angle $\alpha-\Delta\alpha$. In this context, $\Delta\alpha$ can be equal to more than 10°, more than 15°, or even more than 25°. Second portion 270 can thereby even be plastically deformed or bent with respect to first portion 260.

The upward sliding of latching element 240 causes the holding effect of latching element 240 to be reduced in a number of respects.

As the pivot angle of latching element 240 with respect to the extension direction of housing 210 increases, on the one hand the torque acting in a pivoting direction on latching element 240 becomes greater, since the lever arm between the engagement point of latching element 240 on latching stop 175 (the engagement point acts at one end 262 of first portion 260) and latching element root 230 becomes longer and longer. For a given force, the torque that has thereby been elevated causes latching element root 230 to be exposed to an ever-increasing mechanical load.

In addition, the sliding process of latching element 240 along latching stop 175 is further assisted by second portion 170 that is always oriented approximately parallel to latching stop 175. This is because the force exerted by latching stop 175 on latching element 240 is distributed over a large area on the mechanical contact surface, namely over the area of second portion 260. There is therefore no point pressure or linear pressure between latching element 240 and latching stop 175. Latching element 240 therefore has difficulty establishing a frictionally or positively engaged connection with latching stop 175, for example in the manner of a crampon, so as thereby to prevent further upward sliding.

The result is that, upon an application of force, latching element 240 can be bent an increasing distance upward in a self-reinforcing process of increasing torque and decreasing area pressure. This can ultimately result in plastic deformation at latching element root 230, and springback inward as the force is released is then no longer possible. If the force is not released, breakage of latching element 240 at latching element root 230 can even occur. Such behavior is particularly relevant with open latching chambers 173 or with latching chambers 173 that have very tall or long chamber walls 172 or latching stops 175 against which latching element 240 can slide unimpededly upward.

Figure 3A:
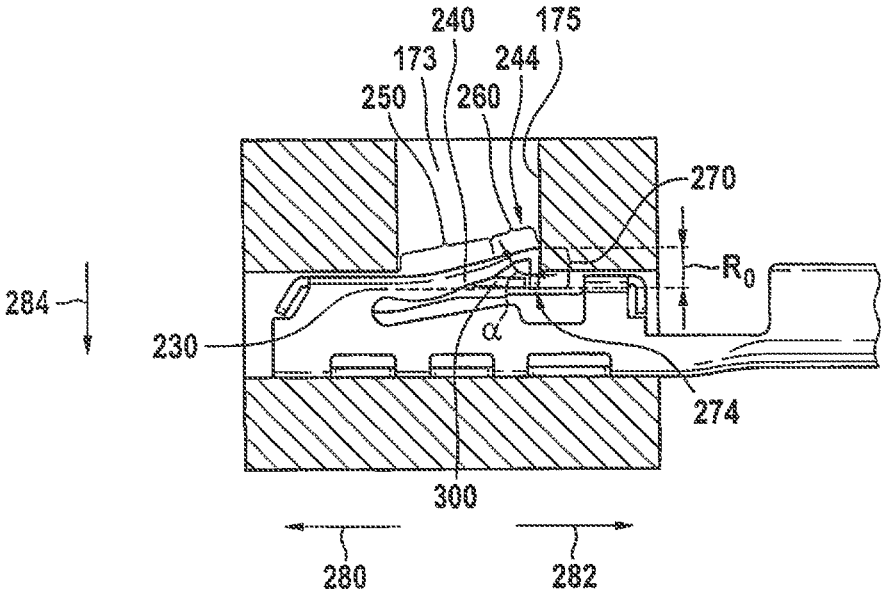
FIG. 3*a* is a schematic cross section of a contact element according to the present invention.

FIG. 3*a* depicts a contact element 200 according to the present invention. In contrast to the contact element of the existing art shown in FIGS. 2*a* and 2*b*, contact element 200 according to the present invention has between first portion 260 and second portion 270 a support element 300 against which, upon application of a force, second portion 270 can brace against first portion 260. The lever arm in the state shown in FIG. 3*a*, with no impingement of force, is labeled $R_0$. It extends in springback direction 284 between end 262 of first portion 260 and latching element root 230. First portion 260 and second portion 270 enclose the angle $\alpha$, $\alpha$ being in a range between 30° and 80°, preferably between 45° and 75°.

Figure 3B:
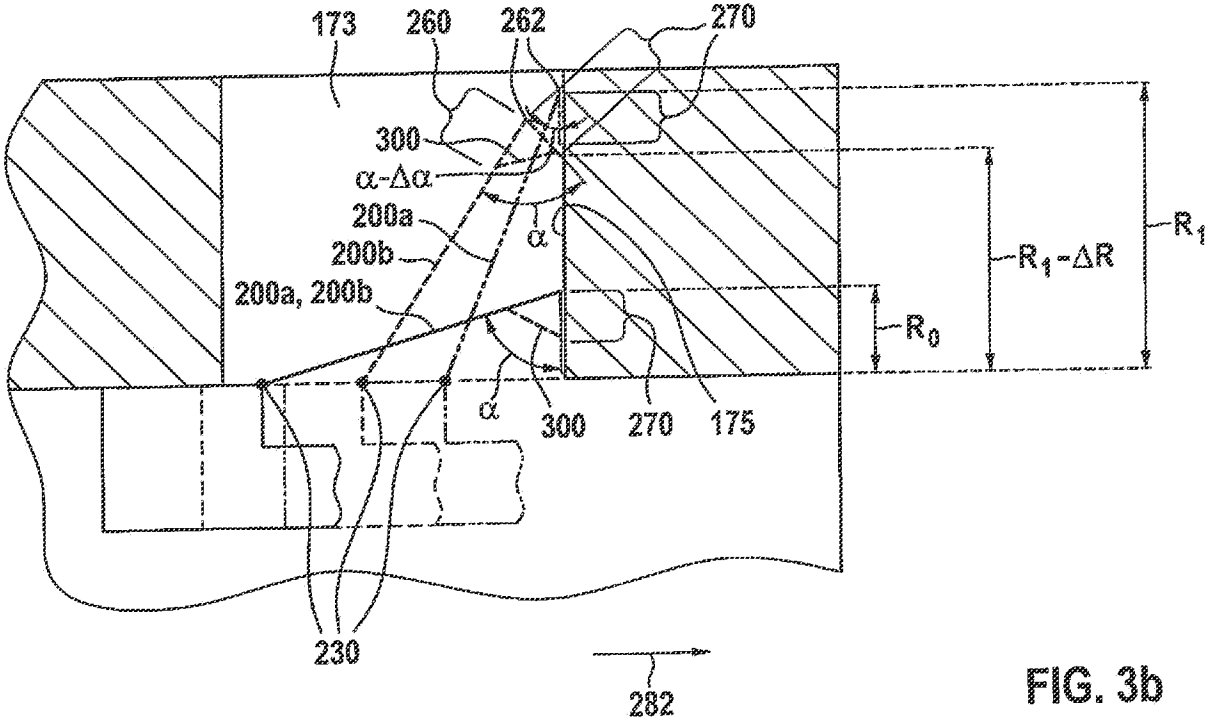
FIG. 3*b* schematically depicts the working principle of the contact element according to the present invention.

FIG. 3*b* schematically depicts the manner in which a conventional contact element 200*a* and a contact element 200*b* according to the present invention behave under an application of force. In the state without force impingement, conventional contact element 200*a* and contact element 200*b* according to the present invention are latched in the same fashion in latching chamber 173. The angle $\alpha$ is enclosed in each case between first portion 260 and second portion 270.

Upon an application of force to contact element 200 along arrow 282 (i.e., oppositely to introduction direction 280), the conventional latching element 240 moves or slides upward on latching stop 175, in which context second portion 270 bends. The angle enclosed by first portion 260 and second portion 270 changes from $\alpha$ to $\alpha-\Delta\alpha$. The force correspondingly acts at end 262 of first portion 260, and the lever arm lengthens, as compared with the zero-force state, from $R_0$ to $R_1$.

Upon the same impingement of force on contact element 200*b*, latching element 240 also slides upward along latching stop 175. Because of support element 300, however, the angle $\alpha$ enclosed between first portion 260 and second portion 270 remains substantially constant. It can decrease, if applicable, by up to, for example, 5° (i.e. decrease by at most 5°) if a small gap exists, for production reasons, between first portion 260 and support element 300 or between second portion 270 and support element 300. The force thereby acts in approximately point-like or linear fashion at free end 274 of second portion 270. The result is to generate a higher local pressure, so that latching element 240 can hook into latching stop 175 with free end 274 of second portion 270. At the same time, the input of force into latching element 240 occurs with a lever arm length that is reduced as compared with the conventional situation. This is because the force input no longer occurs at end 262 of the first portion but occurs instead at the level of support element 300 or at the level of free end 274 of second portion 270. In the example depicted, the length of the lever arm is equal to $R_1-\Delta R$. This reduces the torque (T) acting on latching element 240 or on latching element root 230 for a given force (F), i.e. by an amount $\Delta T=F\times\Delta R$.

For a given force input (e.g. due to a pull on the cable), conventional contact element 200*a* will therefore be pulled appreciably farther out of contact chamber 170 than contact element 200*b* according to the present invention. This is illustrated by the position of latching element root 230.

Further or excessive pivoting of latching element 240 is thereby prevented. As compared with conventional contact element 200*a*, with contact element 200*b* considerably greater forces, for example resulting from a pull on the cable of contact element 200, are necessary in order for latching element 240 to slide upward in latching chamber 173, in the case of contact element 200*b*, in such a way as to exceed a pivot angle at which damage to or failure of latching element 240 (e.g., in the form of plastic deformation), or even breakage of latching element 240, for example at its latching element root 230, occurs. With contact element 200*b* according to the present invention this force is preferably at least 30% greater than with conventional contact element 200*a*, very particularly preferably at least 60% greater. With conventional contact element 200*a*, the pullout force at which failure of latching element 240 occurs can be equal to, for example, at least 15 N, preferably at least 25 N, very particularly preferably at least 40 N.

Figure 4:
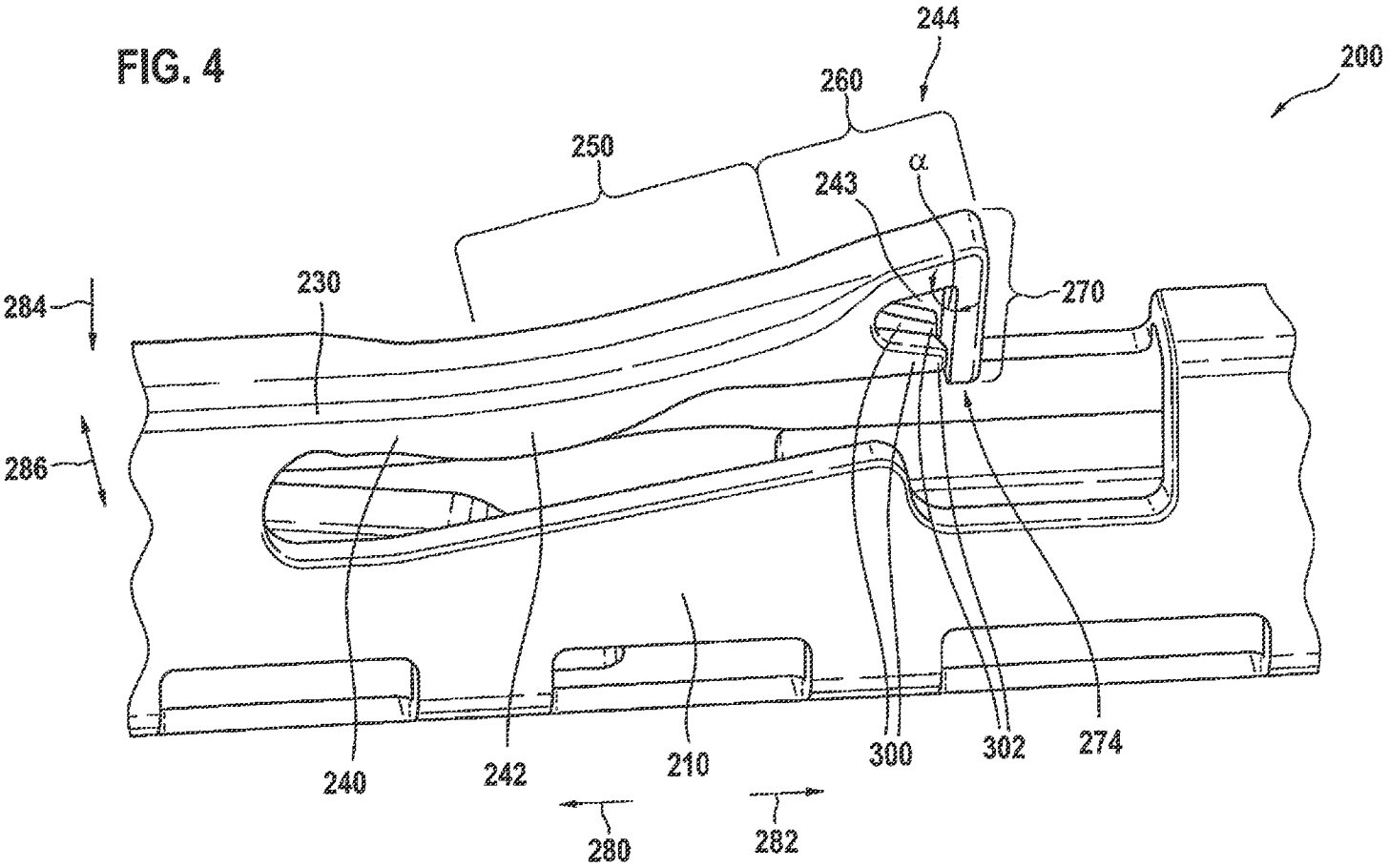
FIG. 4 is a perspective view of an exemplifying embodiment of the latching element of the contact element according to the present invention.

An exemplifying embodiment of contact element 200 according to the present invention is depicted in FIG. 4. Latching element 240 is configured here in substantially planar fashion. Latching element 240 has inwardly bent-over side walls 242 in insertion direction 280 on its outer sides (with respect to lateral axis 286).

In other words, the side walls face with their end faces toward housing 210. In a cross section transverse to insertion direction 280, latching element 240 thus has a profile in the shape of a rotated letter "U". There can also be exemplifying embodiments in which only one side wall 242 is provided. Latching element 240 that is depicted is preferably configured with no appreciable bends in insertion direction 280 with the exception of the bent-over second portion 270. In particular, first portion 260 and second portion 270 are embodied to be flat or planar. They exhibit, in cross section, substantially the shape of a straight line.

Side walls 242 also extend in first portion 260. Here, however, they have cutouts 243 that face toward second portion 270. The exemplifying embodiment that is depicted has two support elements 300 that are disposed in first portion 260 and are fixedly connected to first portion 260. At that end of side walls 242 which faces toward housing 210, the two support elements 300 project in first portion 260, oppositely to insertion direction 280, from side walls 242 to second portion 270. They are embodied in finger-like fashion. The two support elements 300, viewed in insertion direction 280, are completely covered by second portion 270 in lateral direction 286. They thereby make it possible for second portion 280 to brace, upon an application of force to second portion 270 in insertion direction 280, against the two support elements 300 and thus against first portion 260. Bending of second portion 270 with respect to first portion 260, which could result in a decrease of more than 5° in the angle $\alpha$ enclosed between the two portions 260, 270, is thereby prevented. This coverage furthermore prevents damage to sealing mat 180 by support elements 300 projecting oppositely to insertion direction 280 when contact element 200 is unplugged. A small gap can be present for production reasons between second portion 270 and free ends 302 of support elements 300. This gap becomes closed upon an impingement of force onto second portion 270. Such a gap is not, however, obligatorily provided. Support elements 300 can also be in direct mechanical contact with second portion 270 immediately after manufacture. The embodiment having two support elements 300 that brace the outer ends of second portion 270 produces a particularly good supporting effect. For example, second portion 270 is thereby prevented from folding over to one side. With this design the force acting on second portion 270 is also distributed particularly evenly over a larger area, so that damage to the second portion due to a high point load on the support points can be avoided. With the two support elements 300, the pullout force that can result in damage can be increased by at least 30%, depending on the configuration even by at least 60%, as compared with a design having no support element 300.

Figure 5A:
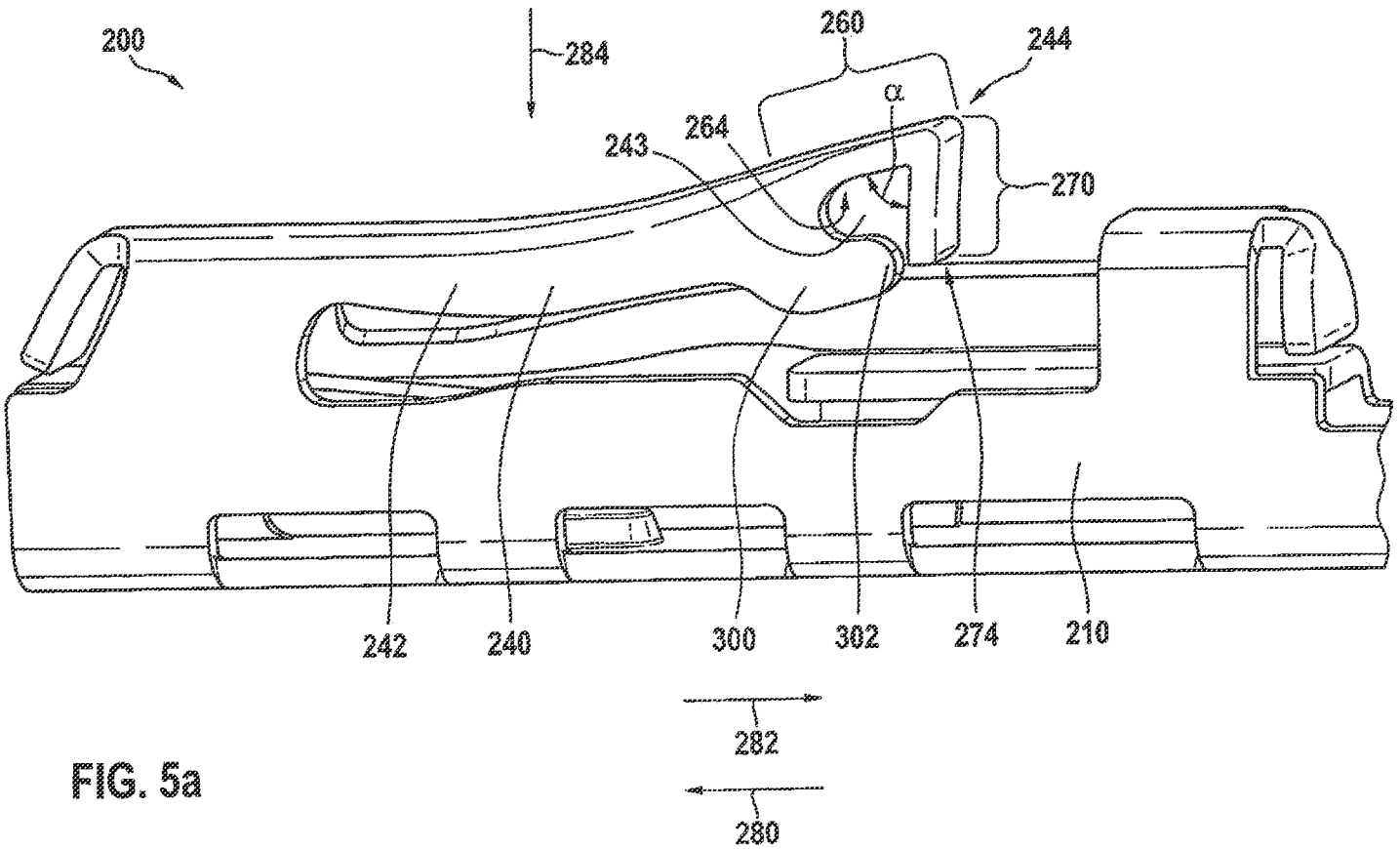
FIG. 5*a* is a perspective view of a further exemplifying embodiment of the contact element according to the present invention.

FIG. 5*a* depicts a further exemplifying embodiment of contact element 200 according to the present invention. In this exemplifying embodiment only a single support element 300, having a free end 302, is provided. As in the exemplifying embodiment of FIG. 4, support element 300 is configured as an extension of one of side walls 242 of latching element 240. Here as well, one cutout 243 is provided in each of side walls 242 in the region of first portion 260.

In contrast to the exemplifying embodiment of FIG. 4, side wall 242 is a little more extensively undercut toward housing 210. The result is that, upon a pivoting of latching element 240, free end 274 of second portion 270 can introduce the force applied onto second portion 270 at a point located particularly low down on latching element 240. The length of the lever arm is thereby, advantageously, particularly significantly decreased. At the same time, the stability of latching element 240 is enhanced by side wall 242 that extends a long way downward, since the area moment of inertia thereby becomes particularly high. In order to allow latching element 240 to deflect sufficiently far inward upon insertion into contact chamber 170, a housing wall in housing 210 located opposite one of side walls 242 is provided with a cutout corresponding to the shape of side wall 242. Upon inward deflection, side wall 242 of latching element 240 therefore does not abut, or does not abut too soon, against housing 210.

Support element 300 is configured in rounded fashion at its free end 302 facing toward second portion 270. On the one hand, this prevents excessively point-like force application onto that side of second portion 270 which faces toward support element 300. In addition, damage to sealing mat 180 can thereby also be avoided. With support element 300, the pullout force that can result in damage can be increased by at least 30%, depending on the configuration even by at least 60%, as compared with a design having no support element 300.

In other words, cantilevered end region 244 of latching element 240 has, considered schematically, the shape of a gripping left hand, where the thumb corresponds to support element 300, the last two finger joints correspond to second portion 270, and the back of the hand and the first finger joint adjoining the back of the hand correspond to first portion 260. Embodiments in which cantilevered end region 244 of latching element 240 has the shape of a gripping right hand are of course also conceivable. In this schematic image, the reinforced region of side wall 242 or the undercut side wall 242 in first portion 260 corresponds to the base of the thumb.

Figure 5B:
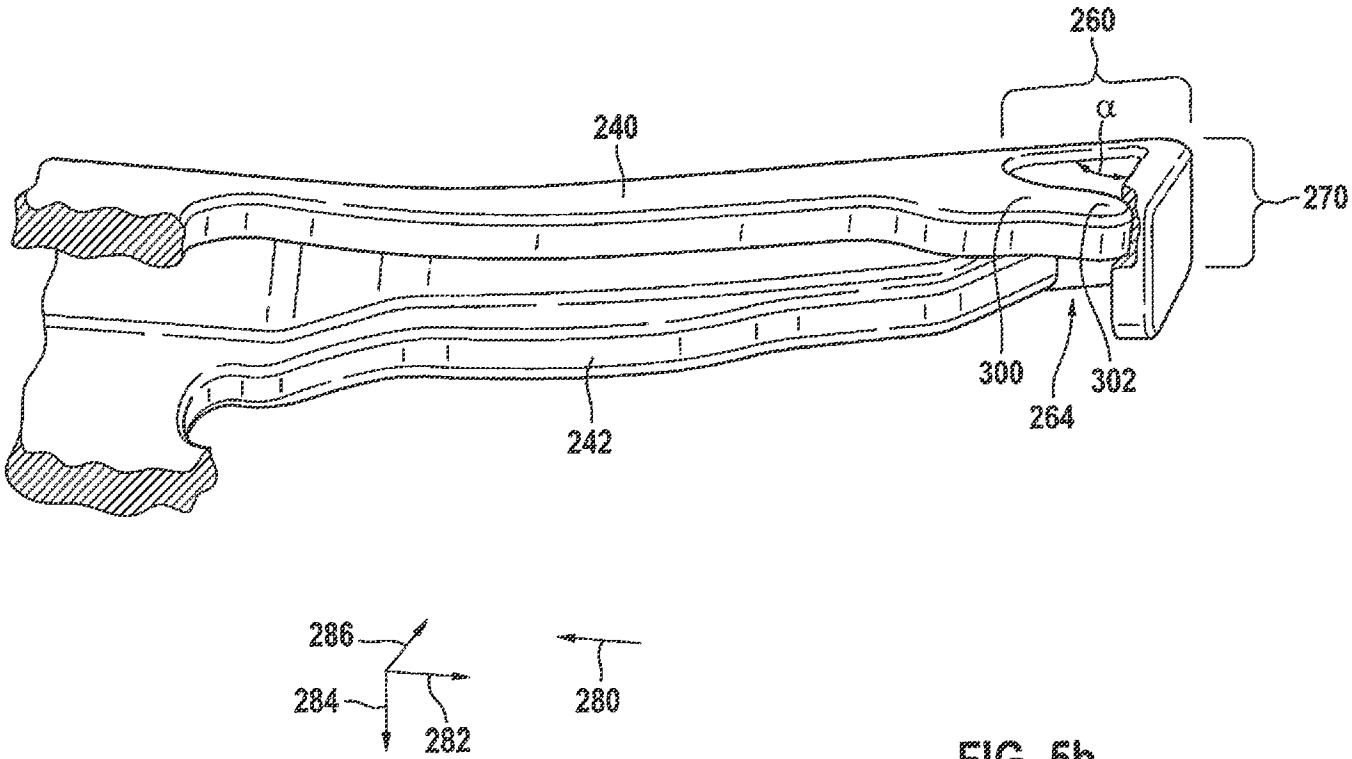
FIG. 5*b* is a perspective view from below of the latching element of the contact element of FIG. 5*a*.

FIG. 5*b* is a view from below of latching element 240 of FIG. 5*a*. It is evident that support element 300, which extends oppositely to insertion direction 280 from side wall 242 to second portion 270, is slightly bent along lateral axis 286 toward the center of second portion 270. The advantageous result of this is that upon an application of force to second portion 270, that second portion 270 cannot bend, for example, at that outer side (with respect to lateral direction 286) with respect to first portion 260 on which no support element 300 is disposed. A further advantageous result thereof is that when contact element 200 is unplugged, damage to sealing mat 180 is reliably prevented by a laterally projecting support element 300.

Figure 5C:
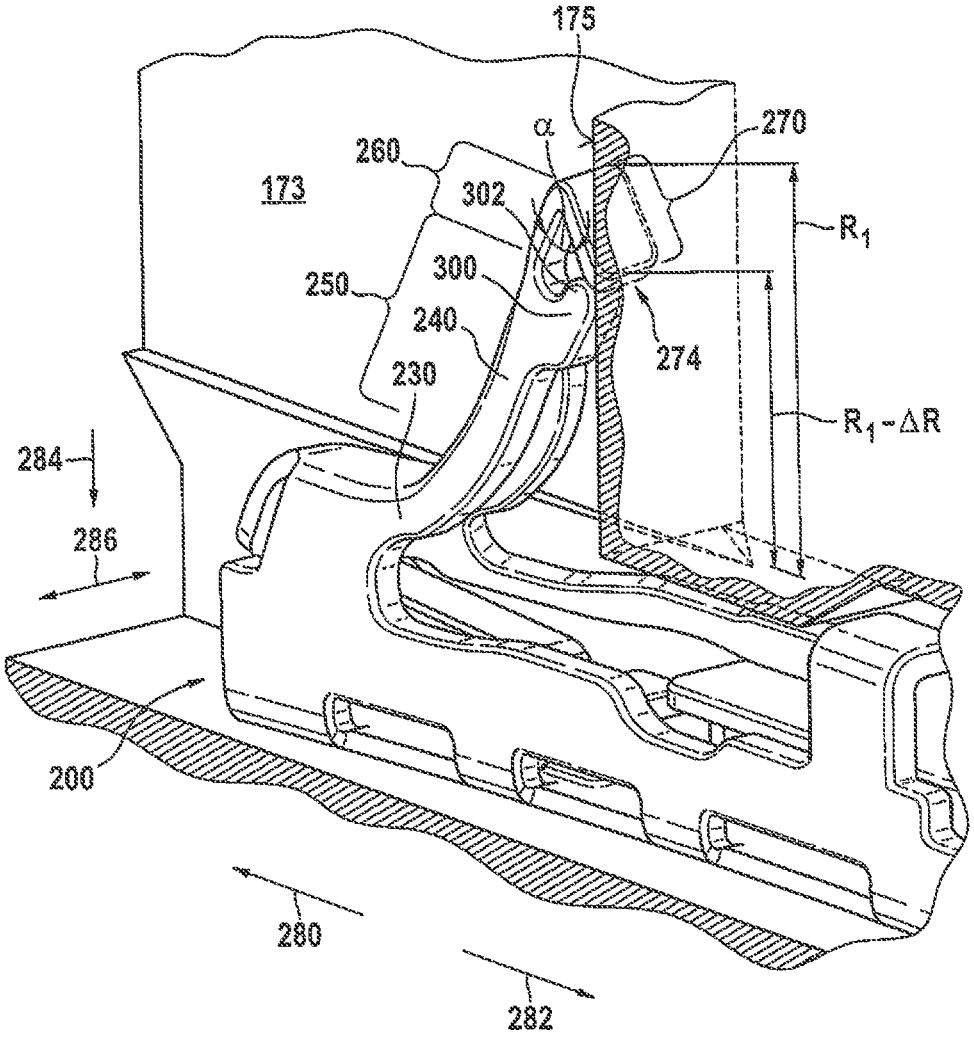
FIG. 5*c* is a perspective view of the contact element of FIG. 5*a*, with an application of force onto the latching element.

FIG. 5*c* shows contact element 200 according to the present invention of FIGS. 5*a* and 5*b* in a state in which a pull is being exerted on contact element 200 in the direction of arrow 282, i.e. oppositely to insertion direction 280. A force therefore acts, in the direction of insertion direction 280, from latching stop 175 to latching element 240. The manner in which support element 300 prevents bending of second portion 270 with respect to first portion 260 is clearly apparent. On the one hand, this significantly reduces the length of the lever arm from $R_1$ to $R_1-\Delta R$. The force is introduced into the side wall (the "base of the thumb") that is of reinforced configuration or extends farther down, which because of that reinforcement is particularly stable. Because second portion 270 does not bend with respect to first portion 260, the force is also introduced in linear form or even in point fashion into free end 274 of second portion 270 (i.e. at the point at which support element 300 braces second portion 270). As a result, free end 274 can hook effectively into the material of latching stop 175, which makes a further upward movement of latching element 240 within latching chamber 173 increasingly difficult as the point-like load increases.

Figure 6:
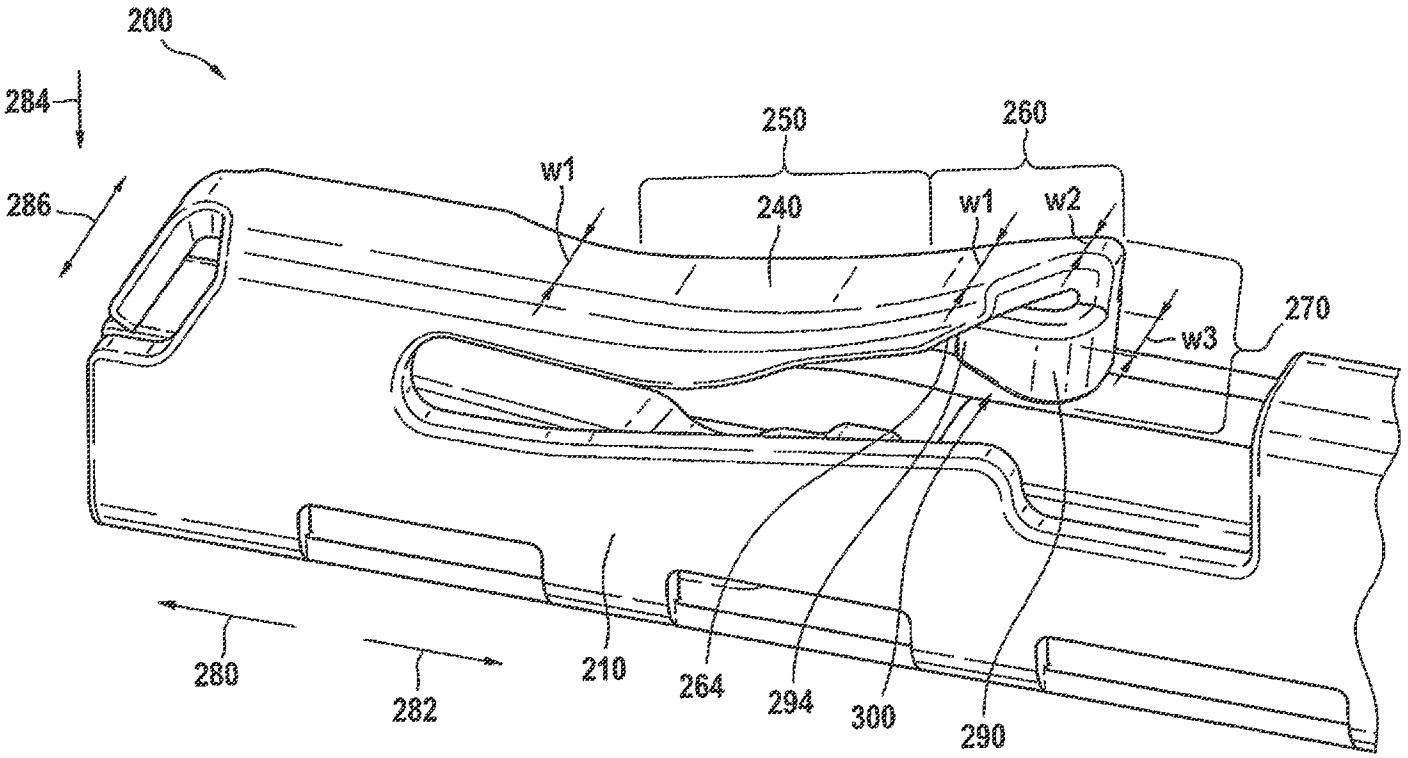
FIG. 6 is a perspective view of a further exemplifying embodiment of the contact element according to the present invention.

FIG. 6 shows a further exemplifying embodiment of contact element 200 according to the present invention. In this exemplifying embodiment support element 300 is configured as a tab 290 projecting laterally from second portion 270 in lateral direction 286, i.e. a, for example thin, piece of sheet metal of elongated configuration. Tab 290 is in turn bent over, after a short segment extending along lateral axis 286, approximately 90° to 135° in insertion direction 280. Tab 290 has a free tab end 294 facing away from second portion 270. This tab end 294 is bent under first portion 260 and, in the event of an impingement of force on second portion 270, can brace second portion 270 against first portion 260. Second portion 270 is braced in this context, via tab 290 and free tab end 294, against an inner side 264, facing toward housing 210, of first portion 260.

In order to prevent damage, for example, to a sealing mat 180 upon insertion of contact 200 due to laterally projecting parts of the second portion or of tab 290, latching element 240 tapers from a first width w1 in first portion 260 to a second width w2 of second portion 270. In other words, second portion 270, viewed along lateral axis 286, is narrower in its transition region to first portion 260 than latching element 240, for example, in further region 250, i.e. second width w2 is less than first width w1. Tab 290 projecting from second portion 270 is bent over in insertion direction 280 in such a way that a total width w3, which results from the second width w2 of second portion 270 and the width of the non-bent portion of tab 290 along lateral axis 286, is less than or at most equal to the first width w1. With the tab-like support element 300, the pullout force that can result in damage can be increased by at least 30%, depending on the configuration even by at least 60%, as compared with a design having no support element 300.

The embodiment depicted is particularly simple to manufacture and makes possible, in particularly simple fashion, a resilient effect upon impingement of a force on second portion 270. As a result, for example, if only a brief pull is exerted on the cable of contact element 200, second portion 270 can be pressed resiliently via tab 290 against inner side 264 of first portion 260. Upon release of the application of force, the return of second portion 270 to its original position with respect to first portion 260 is advantageously assisted by the spring-like curvature of tab 290. In other words, the return of second portion 270 does not need to rely only on the intrinsic elasticity of second portion 270 at its bending point with respect to first portion 260; that return is instead additionally assisted by tab 290 with its spring-like curvature.

Figure 7:
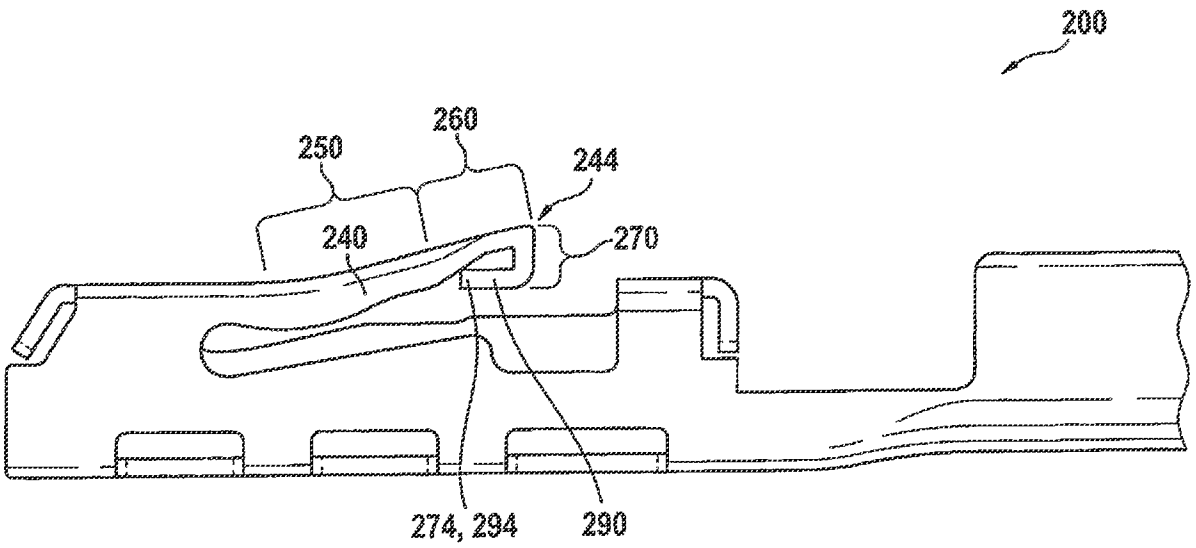
FIG. 7 is a schematic cross section of a further exemplifying embodiment of the contact element according to the present invention.

FIG. 7 schematically depicts a further embodiment of the contact element according to the present invention. In this exemplifying embodiment tab 290 is not disposed laterally on second portion 270. Tab 290 is instead formed by bending over free end 274 of second portion 270. In a side view, free end region 244 of latching element 240 thus has a triangular shape, for example in the shape of the Greek letter delta ("Δ"). In this embodiment, second portion 270 and tab 290 can have the same width when viewed along lateral axis 286, like first portion 260 and like further portion 250. With support element 300 in the shape of the downwardly bent free end 274 of tab 290, the pullout force that can result in damage can be increased by at least 30%, depending on the configuration even by at least 60%, as compared with a design having no support element 300.

The proposed contact element 200 can be used in general for all contacts, mating contacts, or plug-in connector assemblages, for example for contact bushings, in particular for multi-pole contact bushings (e.g., having more than 50 or even more than 120 contact chambers per plug-in connector), for direct plug-in connectors or multipoint contacts. The proposed contact element 200 is particularly well suited for miniaturized contact bushings that have a sheet metal thickness of, for example, 0.1 mm to 0.3 mm in the region of latching element 240.

What is claimed is:

1. A contact element for insertion in an insertion direction into a contact chamber of a plug-in connector, the contact element comprising:

a housing that extends in the insertion direction;

a latching element connected to the housing, for latching into the contact chamber of the plug-in connector, the latching element having a cantilevered end region, the cantilevered end region having a first portion and a second portion connected to the first portion, the first portion one of: i) extending oppositely to the insertion direction, or ii) pointing obliquely outward from the housing oppositely to the insertion direction, the second portion being bent over inward with respect to the first portion; and at least one support element provided between the first portion and the second portion, which element braces the second portion against the first portion upon an application of force onto the latching element;

wherein the latching element is configured in substantially planar fashion, the latching element having at least one side wall bent inward toward the housing, the at least one side wall having at least one cutout in the first portion, the at least one support element being disposed on the at least one side wall, the at least one support element being disposed in a region of the at least one cutout.

2. The contact element as recited in claim 1, wherein the first portion and the second portion enclose an angle α, the at least one support element being configured in such a way that the angle α is decreasable by at most 5° upon an application of force onto the latching element, in particular upon an application of force onto the latching element oppositely to the insertion direction.

3. The contact element as recited in claim 2, wherein the angle α enclosed by the first portion and the second portion is in a range between 45° and 75°.

4. The contact element as recited in claim 1, wherein the at least one support element is configured in one piece with the latching element.

5. The contact element as recited in claim 1, wherein at least one of: i) the at least one support element is connected to the first portion and projects from the first portion, oppositely to the insertion direction, toward the second portion, and ii) the at least one support element is connected to the second portion and projects from the second portion, in the insertion direction, toward the first portion.

6. The contact element as recited in claim 1, wherein the second portion has a free end facing away from the first portion, the at least one support element being disposed on the at least one side wall in such a way that upon an impingement of force in the insertion direction, onto the latching element, the second portion braces with its free end against the at least one support element.

7. The contact element as recited in claim 1, wherein the at least one support element is configured as at least one tab projecting laterally, transversely to the insertion direction, from the second portion, the at least one tab being bent over 90° to 135° at least locally in the insertion direction.

8. The contact element as recited in claim 7, wherein the at least one tab has a free tab end, the free tab end bracing against an inner side, facing toward the housing, of the first portion upon an impingement of force in the insertion direction, onto the latching element.

9. The contact element as recited in claim 7, wherein the latching element has a further portion having a first width w1 in a lateral direction transverse to the insertion direction, the first portion being disposed between the further portion and the second portion, the first portion tapering toward the second portion from the first width w1 to a second width w2 of the second portion, the second portion and the tab having, in the lateral direction, a total width w3 that is less than or equal to the first width w1.

* * * * *